US006286712B1

(12) United States Patent
Craig et al.

(10) Patent No.: US 6,286,712 B1
(45) Date of Patent: Sep. 11, 2001

(54) STACK FORMED FROM CONNECTED GROUPS OF INTERFOLDED SHEETS

(75) Inventors: Grantland A. Craig; James E. Hertel; Gary E. Johnson; Wayne W. Luebke, all of Green bay, WI (US); Peter A. Heath, Plymouth (GB); Thomas D. Huempfner, Suamico; John H. Wunderlich, Green Bay, both of WI (US)

(73) Assignee: Paper Converting Machine Co, WI (US)

( * ) Notice: Subject to any disclaimer, the term of this patent is extended or adjusted under 35 U.S.C. 154(b) by 0 days.

(21) Appl. No.: 09/488,877

(22) Filed: Jan. 21, 2000

Related U.S. Application Data

(63) Continuation-in-part of application No. 09/405,827, filed on Sep. 24, 1999, now abandoned.

(51) Int. Cl.[7] ..... A47K 10/24
(52) U.S. Cl. ..... 221/48; 206/494
(58) Field of Search ..... 221/33, 45, 46, 221/48, 49, 63; 206/494, 449, 460, 812; 312/35.1, 50

(56) References Cited

U.S. PATENT DOCUMENTS

| | | | |
|---|---|---|---|
| 2,809,082 | 10/1957 | Marcuse . | |
| 4,064,880 | 12/1977 | Logan . | |
| 4,416,392 | 11/1983 | Smith . | |
| 4,674,634 | 6/1987 | Wilson . | |
| 4,776,649 | 10/1988 | ten Wolde . | |
| 5,033,620 | 7/1991 | De Luca . | |
| 5,050,909 | 9/1991 | Mertens et al. . | |
| 5,520,308 | 5/1996 | Berg et al. | 221/50 |

*Primary Examiner*—Kenneth W. Noland

(57) ABSTRACT

A stack of interfolded sheets is formed from a plurality of groups of interfolded sheets. Adjacent groups are secured or bonded together so that the bottom sheet of each group pulls the top sheet of the next group. In one embodiment of the invention, the strength of the bond is such that when the bottom sheet of a group is withdrawn through an opening in a package for the stack, the bond releases the top sheet of the next group after the top sheet is partially withdrawn through the opening. In another embodiment of the invention, the strength of the bond is such that the top sheet remains secured to the bottom sheet and is completely withdrawn through the opening. The sheets can be secured by an adhesive bond or by a non-adhesive bond.

28 Claims, 10 Drawing Sheets

STACK FORMED FROM CONNECTED GROUPS OF INTERFOLDED SHEETS

RELATED APPLICATION

This application is a continuation-in-part of co-pending application entitled "Stack Formed From Adhesively Connected Groups of Interfolded Sheets," Ser. No. 09/405,827 filed Sept. 24, 1999 now abandoned.

BACKGROUND

This invention relates to interfolded sheets of wipes or similar material. More particularly, the invention relates to a stack of interfolded sheets which is formed from connected groups of interfolded sheets.

Paper products such as sheets of tissues and towels are conventionally folded and superposed to form a stack which may be stored in a container or dispenser. It is desirable to interfold or interleave the sheets of the stack so that removing the top sheet from the container causes the next sheet to "pop up" or move into position for removal. The folded sheets can be either wet or dry.

Stacks of interfolded sheets are conventionally formed by slitting a wide web into a plurality of narrow webs which are fed to a folder which interfolds the webs. If the stack contains, for example, 100 individual sheets, then 100 separate narrow webs are fed to the folder. The interfolded webs are cut into a plurality of separate consumer-sized stacks, and each stack is packaged in a separate container.

Folding machines which interfold a large number, for example, 50 to 100, individual webs are relatively complex and expensive. More economical folding machines are available for interfolding a lesser number of webs, for example, 5 to 10. The interfolded webs are cut into a plurality of groups of interfolded webs, and each group of interfolded webs is called a clip. The number or count of interfolded webs in clips which can be produced by the more economical machines is relatively small.

Commercial packages of interfolded wipes or tissues commonly have counts of 40 to 100 or more. If the economical, low count folding machine is used to form such a package by combining a number of clips, the bottom sheet of each clip will not be interfolded with the top sheet of the next clip. The package will therefore not have a continuous dispensing feature since the top sheet of each clip will have to be manually withdrawn from the package. As a result, the economical, low count machines are generally not used to provide interfolded webs.

U.S. Pat. No. 5,520,308 describes a tissue package which is produced without any interfolding apparatus. The tissues are not interfolded, and adjacent tissues are releasably attached by, for example, adhesive.

SUMMARY OF THE INVENTION

The invention permits an economical, low count folding machine to be used for producing high count interfolded sheets by connecting clips of interfolded sheets. In one embodiment of the invention the clips are adhesively connected. The bottom sheet of each clip is adhesively bonded to the top sheet of the next clip so that, as the bottom sheet of one clip is withdrawn from the package, the top sheet of the next clip is partially withdrawn.

The clips can also be connected by non-adhesive means. For example, the sheets can include polypropylene staple fibers which provide a mechanical bond.

In one form of the invention, the strength of the adhesive or non-adhesive bond is adequate to withdraw a portion of the top sheet through the dispenser opening of the package but weak enough to break before the top sheet is completely withdrawn from the package. In another form of the invention, the bottom sheet of one clip and the top sheet of the next clip are partial width sheets rather than full width sheets and the partial sheets are permanently bonded together. The permanently bonded sheets form a full width sheet which is interfolded with both clips to provide continuous dispensing.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
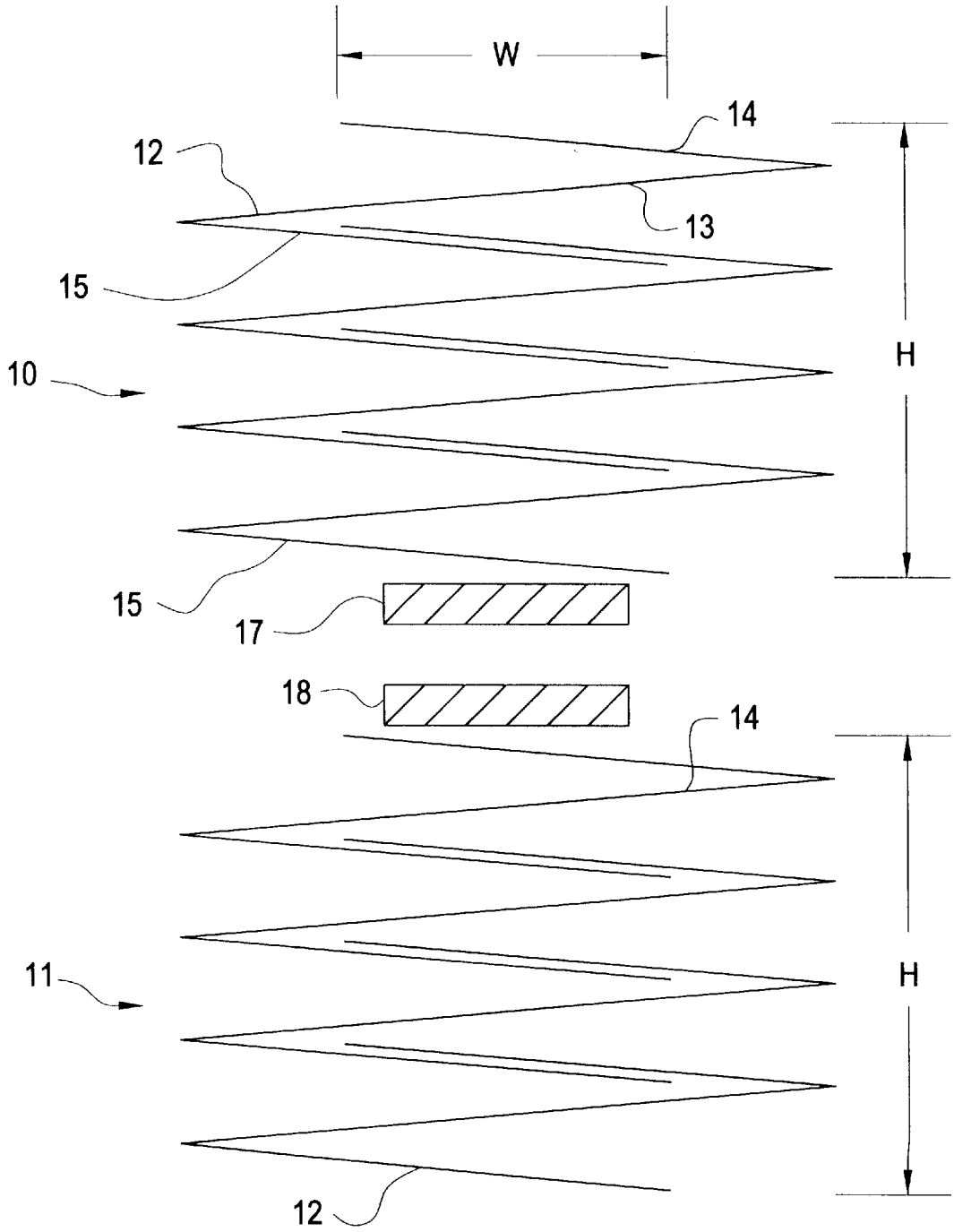
FIG. 1 illustrates a pair of clips of interfolded sheets and adhesive applied to the bottom sheet of the top clip and to the top sheet of the bottom clip for adhesively connecting the two clips.

Referring to FIG. 1, a pair of clips or small groups 10 and 11 of interfolded sheets 12 are superposed to form a stack. The height of each clip is indicated by the dimension H. It will be understood that a complete stack will include as many clips as are needed to provide the desired count.

The sheets 12 in FIG. 1 are provided with a conventional Z fold. Each Z folded sheet includes a center panel 13 and top and bottom panels 14 and 15. The sheets of each clip are interfolded by interleaving the top and bottom panels of adjacent sheets. The overlapping portions of the sheets form a fold lap having a width dimension W in the center of the clip.

In the embodiment illustrated in FIG. 1, each of the clips includes four individual sheets 12. However, the counts of the clips can vary depending upon the equipment which is used to form the clips and other considerations. Low cost economical folding machines typically produce clips having counts ranging from 4 to 12.

A layer of adhesive 17 is applied to the bottom panel 15 of the bottom sheet of the clip 10. A layer of adhesive 18 is applied to the top panel 14 of the top sheet of the clip 11. The width of the adhesive layers 17 and 18 corresponds to the width W of the fold lap. However, the pattern, location, and registration of the adhesive may vary.

The adhesive 17 and 18 adhesively connects the two clips 10 and 11. If more clips are used to form the complete stack, then the additional clips are adhesively connected in a similar manner.

FIGS. 7–11 illustrate representative patterns which can be used to form the adhesive layers 17 and 18. The specific patterns illustrated are formed by hotmelt spray guns available from Nordson Corporation of Norcross, Georgia. Other adhesive patterns can also be used.

Figure 7:
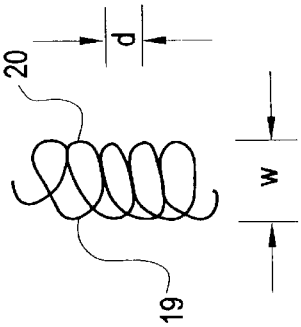

FIG. 7 illustrates a swirl pattern 19 which is currently preferred. The swirl pattern is formed by a series of loops 20, and the distance d between adjacent loops and the width w of the loops can be adjusted to vary the strength of the adhesive bond.

Figure 8:
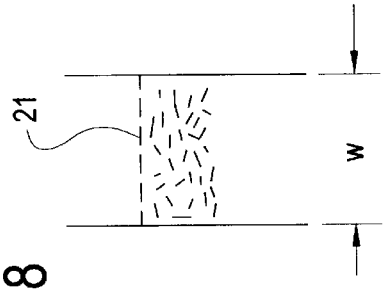

FIG. 8 illustrates a spray pattern 21 which provides an non-continuous layer of adhesive over a width w, which may be the same as, or narrower than the width of the clip.

Figure 9:
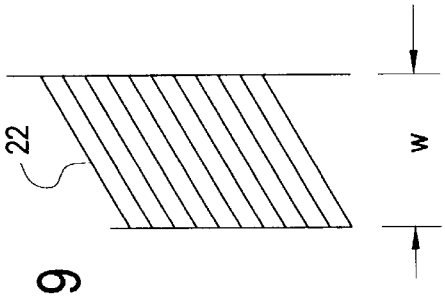
FIGS. 7–11 illustrate representative adhesive patterns which can be used for adhesively connecting the clips.

FIG. 9 illustrates a film pattern 22 which provides a continuous layer of adhesive over a width w. The length of the continuous layer of adhesive extends parallel to the long dimension of the clip.

Figure 10:
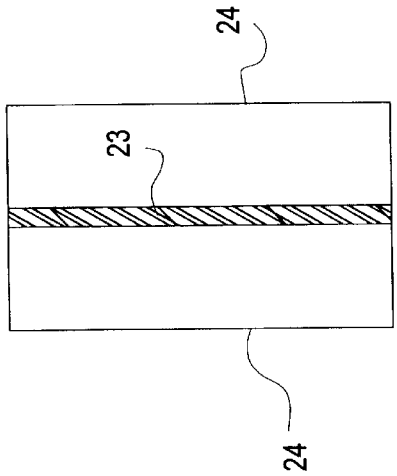

FIG. 10 illustrates a continuous line 23 of adhesive which is applied in the middle of the clip and parallel to the long side edges 24 of the clip.

Figure 11:
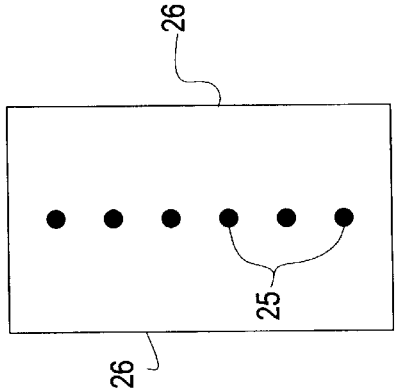

FIG. 11 illustrates intermittent dots 25 of adhesive which are aligned in a direction which is parallel to the long side edges 26 of the clip.

All of the adhesive patterns can be applied to either wet or dry sheets and may be applied to both or only one of a pair of adjacent clips. Wet or moistened sheets are commonly used as wipes for cleaning, for example, skin.

Figure 2:
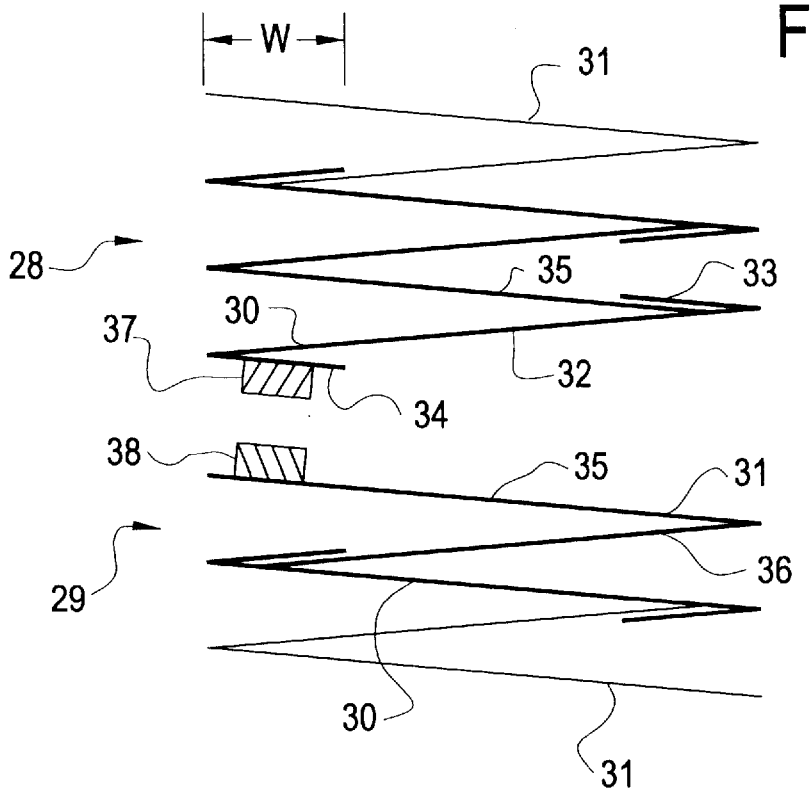
FIGS. 2–4 illustrate portions of a pair of adhesively connected clips which use other types of interfolds.

FIG. 2 illustrates portions of a pair of clips 28 and 29 which are formed by Z folded sheets 30 and V folded sheets 31. Each Z folded sheet includes a center panel 32 and top and bottom panels 33 and 34. Each V folded sheet includes top and bottom panels 35 and 36. The sheets of each clip are interfolded to form fold laps having a width W along the right and left edges of the stack. FIG. 2 shows only a portion of each clip, and the complete clip includes more interfolded Z and V sheets.

A layer of adhesive 37 is applied to the bottom panel 34 of the bottom sheet of the clip 28 and a layer of adhesive 38 is applied to the top panel 35 of the top sheet of the clip 29. The clips are thereby adhesively connected.

Figure 3:
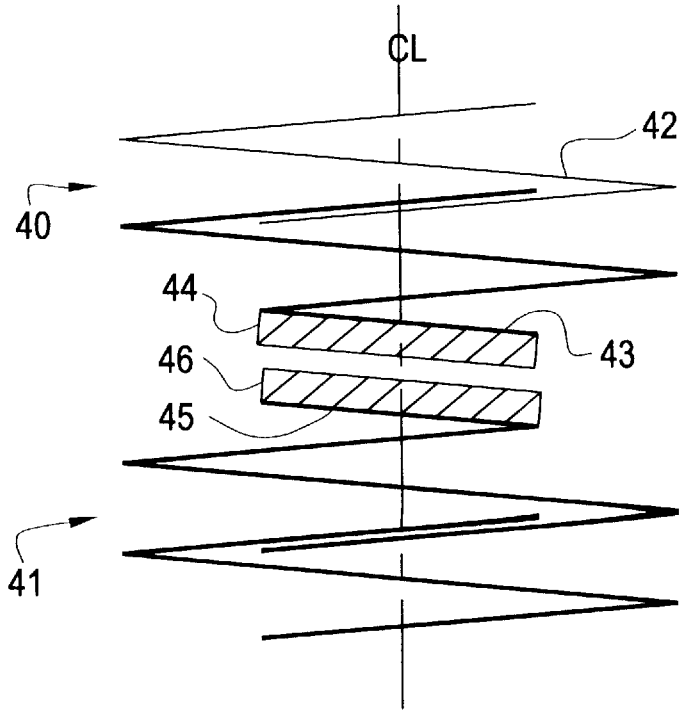

FIG. 3 illustrates a pair of clips 40 and 41 of Z folded sheets 42. The bottom panel of the bottom sheet of each clip is folded to form a starter flap or tab 43 to which a layer of adhesive 44 is applied. The top panel of the top sheet of the next clip is similarly folded to form a starter flap or tab 45 to which a layer of adhesive 46 is applied. The flaps 43 and 45 are aligned with the center line CL of the stack which is formed by the clips so that the adhesive bond is at or near the center line.

In FIGS. 1–3 a full width sheet of one clip is adhesively bonded to a full width sheet of the next clip. The adhesive bond is relatively weak. The adhesive bond is strong enough to partially withdraw the top sheet of the second clip through the dispenser opening, but the adhesive bond breaks before the top sheet is completely withdrawn from the package. Breaking the adhesive bond provides two separate full width sheets.

Figure 4:
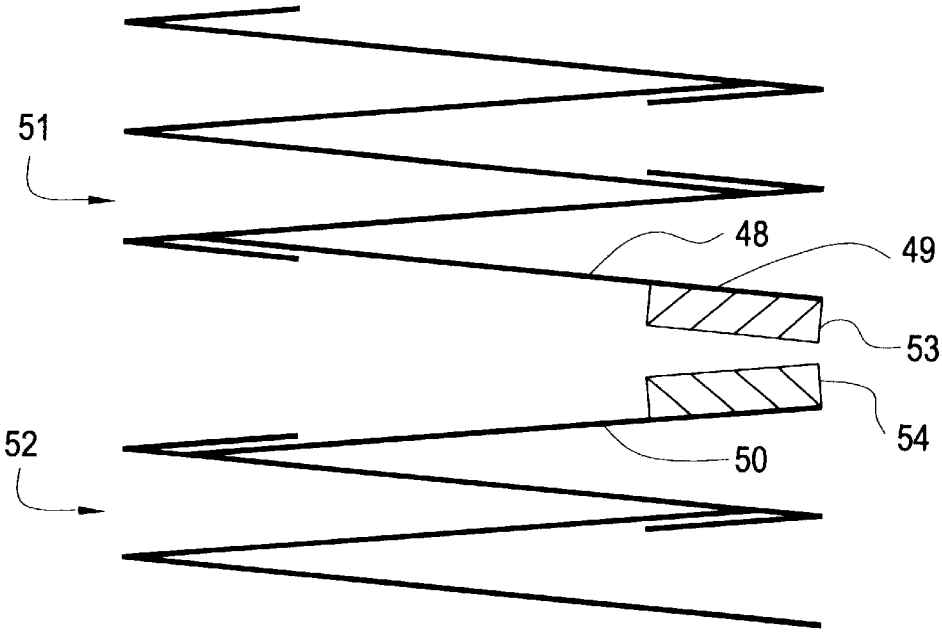

FIG. 4 illustrates a Z-V fold similar to the Z-V fold of FIG. 2. However, a V folded sheet 48 is split to form separate panels 49 and 50. Alternatively, the panels 49 and 50 can be formed by slitting an unfolded flat sheet into two partial width sheets. The panel 49 forms the bottom of clip 51, and the panel 50 forms the top of clip 52. The panels 49 and 50 are adhesively connected by layers of adhesive 53 and 54. The adhesively connected panels form one wipe which remains intact when the wipe is withdrawn. The adhesive bond is strong enough to permanently bond the two panels to form one full width sheet. As used herein, "permanent bond" means that the bond between two panels is sufficient to withstand the pulling force necessary to withdraw both panels from the package. The bond should also be strong enough to maintain the attached between panels during normal use of the panels, for example as a wipe. The top and bottom panels of the adhesively connected wipe are interfolded with the clips 51 and 52 to provide continuous dispensing.

Figure 5:
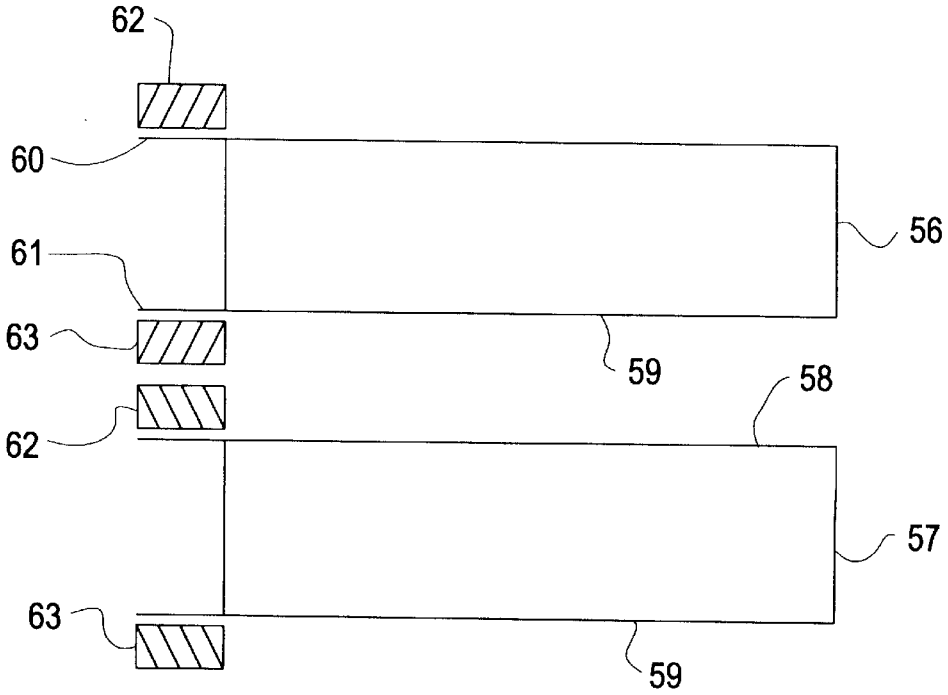
FIG. 5 is a diagrammatic illustration of a pair of clips in which the upper and lower sheets include laterally extending flaps for adhesively connecting the clips.

FIG. 5 diagrammatically illustrates a pair of clips 56 and 57 which are formed from conventional interfolded sheets. However, the top and bottom panels 58 and 59 of each clip extend laterally beyond one of the side edges of the clip to form flaps 60 and 61. Adhesive layers 62 and 63 are applied to the flaps for adhesively connecting adjacent clips.

Figure 6:
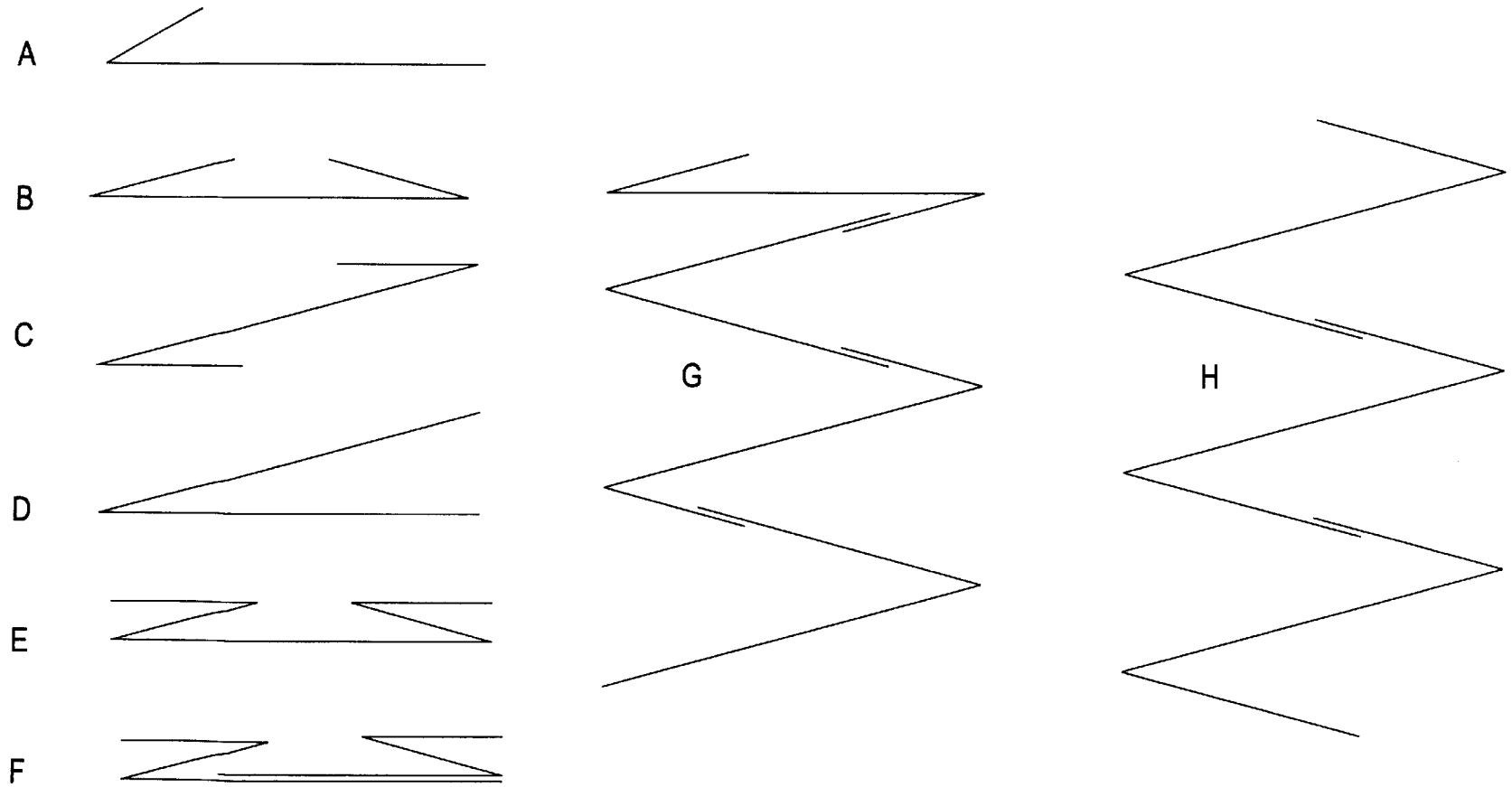
FIGS. 6(*a*) through 6(*h*) illustrate various types of folds which can be used to form clips of interfolded sheets.

FIG. 6 illustrates some of the various folds which can be used with the invention:

FIG. 6(*a*): J fold

FIG. 6(*b*): C fold

FIG. 6(*c*): Z fold

FIG. 6(*d*): V fold

FIG. 6(*e*): C fold with wings

FIG. 6(*f*): modified V fold

FIG. 6(*g*): V-Z fold

FIG. 6(*h*): Z interfold

Figure 12:
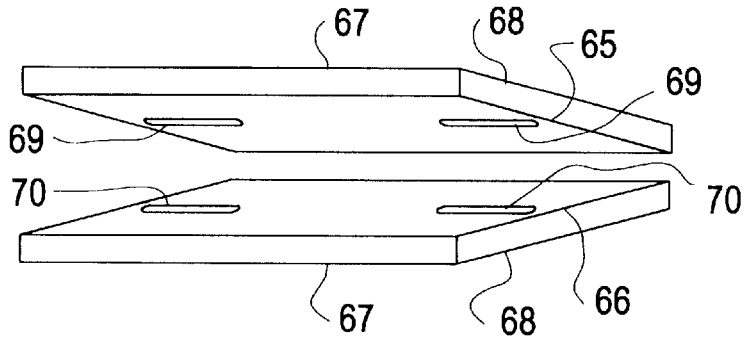
FIG. 12 is a perspective view of a pair of clips which are connected by matching, intermittent glue patterns on the top and bottom of the clips.

FIG. 12 illustrates a pair clips 65 an 66. Each of the clips is rectangular and has long side edges 67 and short side edges 68. Discrete adhesive patterns 69 are applied to the bottom panel of the top clip, and matching or registered adhesive patterns 70 are applied to the top panel of the bottom clip. it is also possible to apply adhesive to only one of the clips. The clips will be adhesively connected when they are pressed together.

Figure 13:
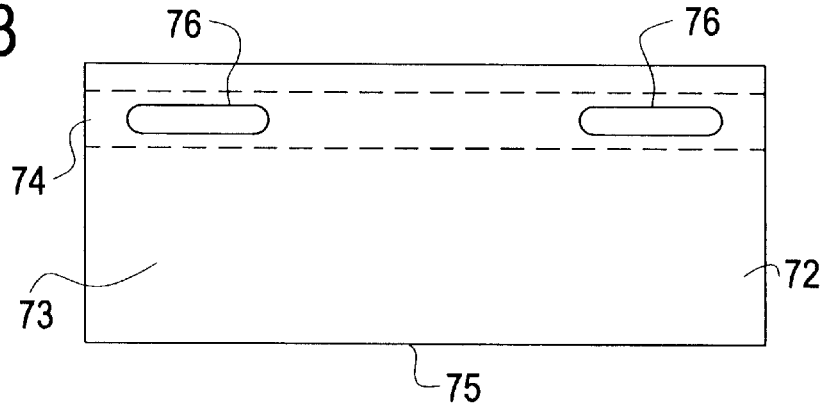
FIG. 13 is a plan view of a clip of moistened sheets, the top sheet having a dry strip to which patterned adhesive is applied.

FIG. 13 illustrates the top panel 72 of a clip which is formed from interfolded wet or moistened sheets. The top panel 72 includes a wetted area 73 and a dry strip 74 which is not wetted or moistened and which extends parallel to the long side edges 75 of the clip. Patterned adhesive 76 is applied to the panel in the dry strip. The facing panel of the next clip may also have a dry strip to which adhesive is applied.

Figure 14:
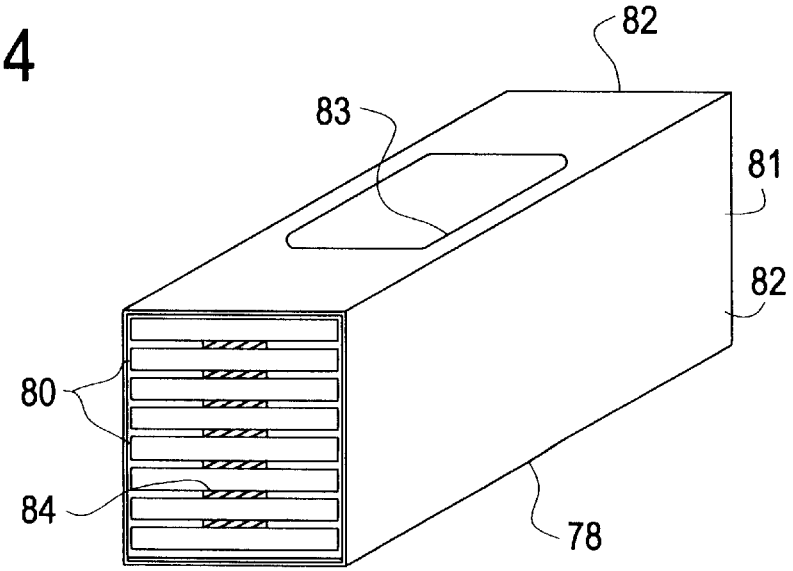
FIG. 14 illustrates a stack of adhesively connected clips of interfolded sheets in a dispensing package.

FIG. 14 illustrates a package 78 which comprises a stack 79 of a plurality of adhesively connected clips 80 which are contained in a dispensing container 81. The container 81 includes a plurality of sidewalls 82, and one of the sidewalls is provided with a dispenser opening 83.

When the first sheet of the top clip 80 is withdrawn through the dispenser opening 83, the overlapping portion of the next sheet of the interfolded sheets is withdrawn through the dispenser opening. The bottom sheet of each clip is adhesively connected to the top sheet of the next lower clip by adhesive 84.

If the top and bottom sheets of adjacent clips are full width sheets, the adhesive bond between those sheets is relatively weak so that when the bottom sheet of a clip is withdrawn through the opening, the adhesive connection will pull the top sheet of the next clip partially through the dispenser opening. The adhesive bond will break before the top sheet of the next clip can be fully withdrawn through the opening.

If the top and bottom sheets of adjacent clips are partial width sheets, the adhesive bond is strong enough to pull the top sheet of the next clip completely through the dispenser opening. The two partial width sheets will remain adhesively attached to form a sheet having substantially the same width as the other sheets.

The shape of the dispenser opening can vary depending upon the geometry of the interfold and/or the location and volume of the adhesive. The opening needs to provide enough friction or resistance to separate the sheets if the sheets are full width sheets.

Figure 15:
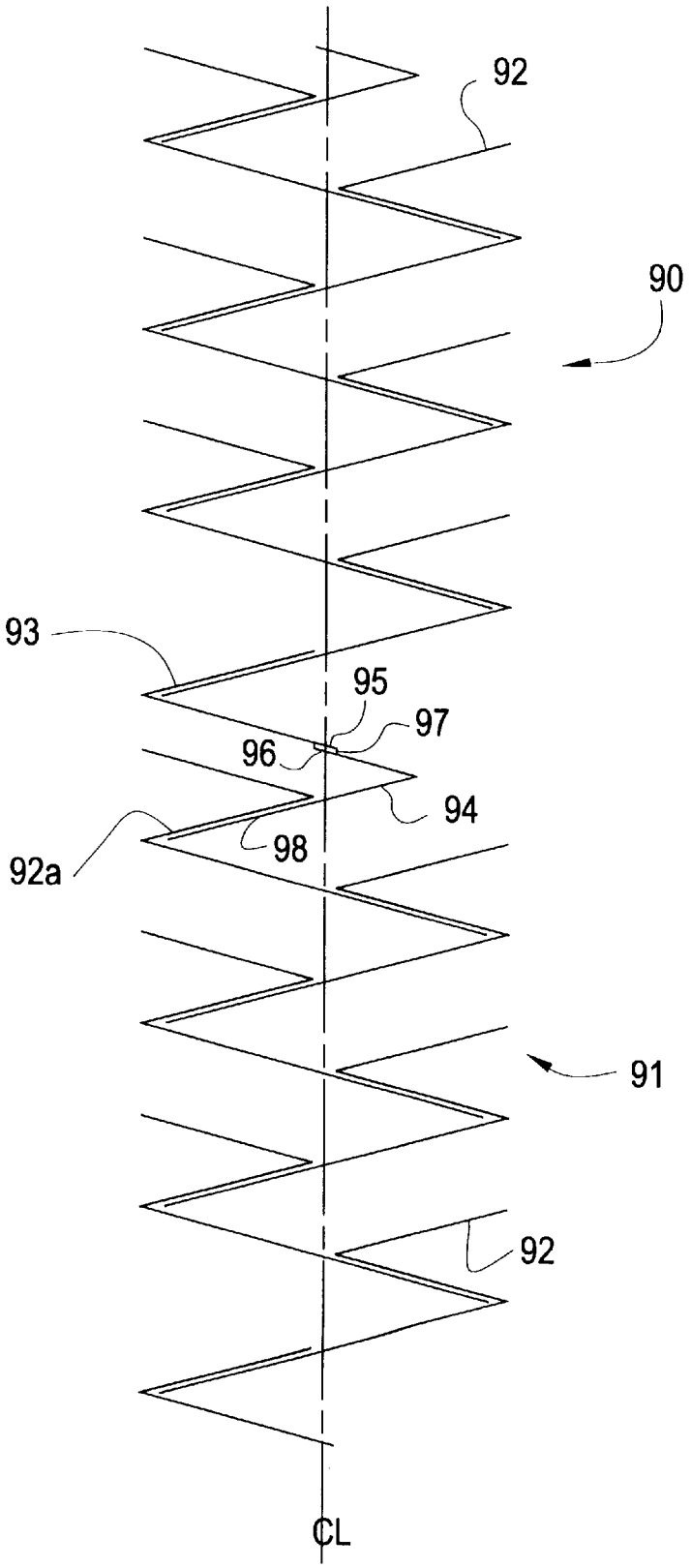
FIG. 15 illustrates a pair of clips of modified Z interfolded sheets in which adjacent clips include partial width sheets which are permanently adhesively bonded together.

FIG. 15 illustrates a pair of clips 90 and 91 of modified Z interfolded sheets 92. The upper clip 90 includes a bottom sheet 93 which has an unfolded width less than the unfolded width of the other sheets 92. Similarly, the lower clip 91 includes a top sheet 94 which has an unfolded width which is less than the unfolded width of the sheets 92.

The sheet 93 includes a lower edge portion 95 which overlaps an upper edge portion 96 of the top sheet 94, and the overlapping portions are secured by adhesive 97. The adhesive bond 97 is strong enough so that when the bottom sheet 93 of clip 90 is withdrawn through the opening of a container or package, for example, the opening 83 of package 78 in FIG. 14, the top sheet 94 of the next clip 91 is fully withdrawn through the opening along with the sheet 93. The sheets 93 and 94 remain adhesively attached after withdrawal from the package, and the adhesively attached sheets 93 and 94 form a single wipe.

The sheet 94 includes a lower panel 98 which is interfolded with the next sheet 92*a* of the lower clip 91. Accordingly, when the adhesively attached sheets 93, 94 are withdrawn from the package, the next sheet 92*a* is partially withdrawn from the package to provide continuous dispensing.

The partial width sheets 93 and 94 can be formed by a slitting and folding process which is performed by a standard economical low count folding machine. The slit position is adjusted to provide the desired partial widths for the sheets 93 and 94, and the folding boards of the folding machine are designed and positioned to provide the overlapping portions 95 and 96 which will be secured with adhesive.

The overlapping portions 95 and 96 provide a lap joint for the adhesive so that a pulling force which is applied to the lower end portion of the sheet 93 will be aligned with the pulling force which is transmitted to the upper portion of the sheet 94. The width of the overlapping portions is advantageously about ¼ inch to about 1 inch. In one specific embodiment of the invention, the overlapping portions had a width of 0.625 inch. The overlapping portions are desirably aligned with the center line CL of the stack which is formed by the clips.

The adhesively bonded sheets 93 and 94 are interfolded with the sheets immediately above and below the sheets 93 and 94 in the same way that the sheets 92 are interfolded to provide consistent dispensing throughout the stack. Also, the combined open width of the adhesively connected sheets 93 and 94 is advantageously the same or substantially the same as the open width of the sheets 92.

Figure 16:
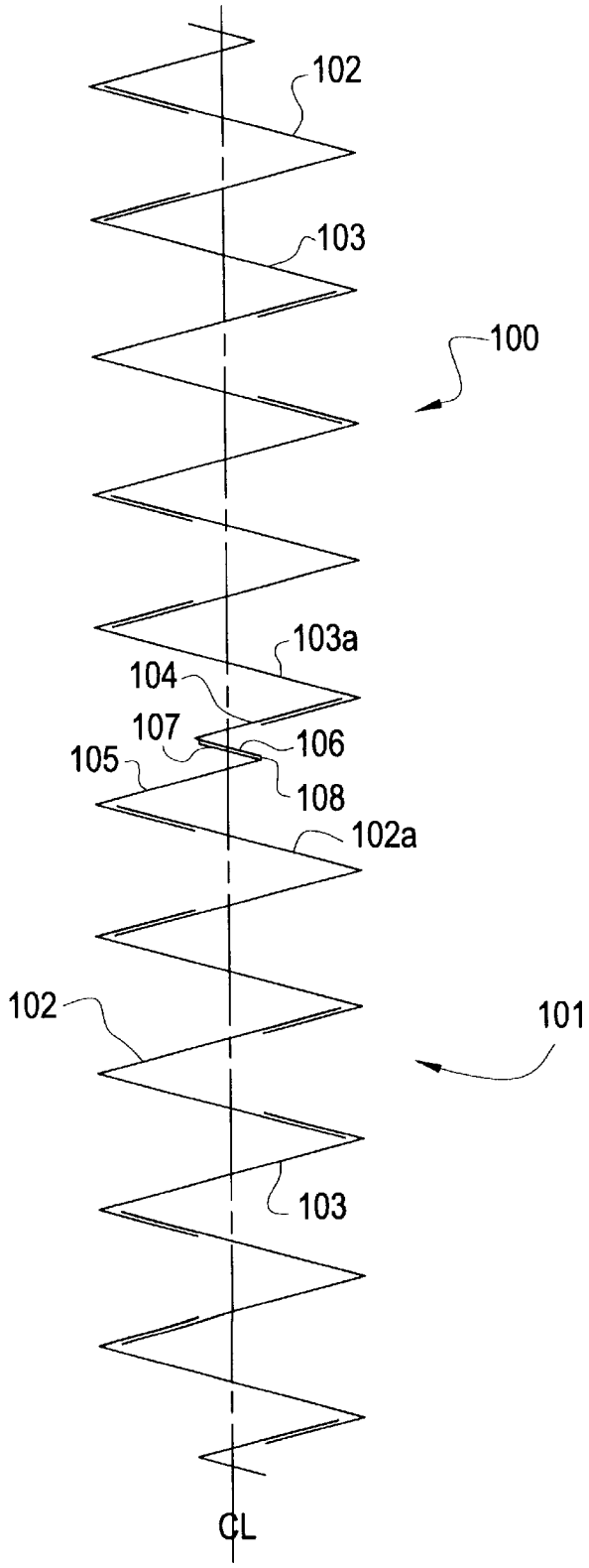
FIG. 16 illustrates a pair or clips of V-Z interfolded sheets in which adjacent clips include partial width sheets which are permanently adhesively bonded together.

FIG. 16 illustrates a pair of clips 100 and 101 of V-Z interfolded sheets which include V folded sheets 102 and Z folded sheets 103. The unfolded widths of the V folded sheets 102 and the Z folded sheets 103 are advantageously substantially the same.

The clip 100 includes a bottom partial width sheet 104 which is interfolded with the lowermost Z folded sheet 103*a*, and the clip 101 includes a top partial width sheet 105 which is interfolded with the uppermost V folded sheet 102*a*. The bottom partial width sheet 104 includes a lower end portion 106 which overlaps an upper end portion 107 of the partial width sheet 105. The overlapped portions form a lap joint which is secured by adhesive 108.

The adhesive bonds 108 which join the bottom partial width sheet of each of the clips to the top partial width sheet of the next clip are aligned along the center line CL of the stack, and the partial width sheets 104 and 105 are bonded together to form a sheet which is interfolded in the same way as the other sheets of the stack to provide consistent and continuous dispensing. The strength of the adhesive bond 108 is such that the partial width sheets 104 and 105 will remain adhesively bonded as they are withdrawn from the package and thereafter during normal use. The unfolded width of the adhesively bonded sheets 104 and 105 is advantageously the same or substantially the same as the unfolded widths of the V-folded sheets 102 and the Z-folded sheets 103.

Figure 17:
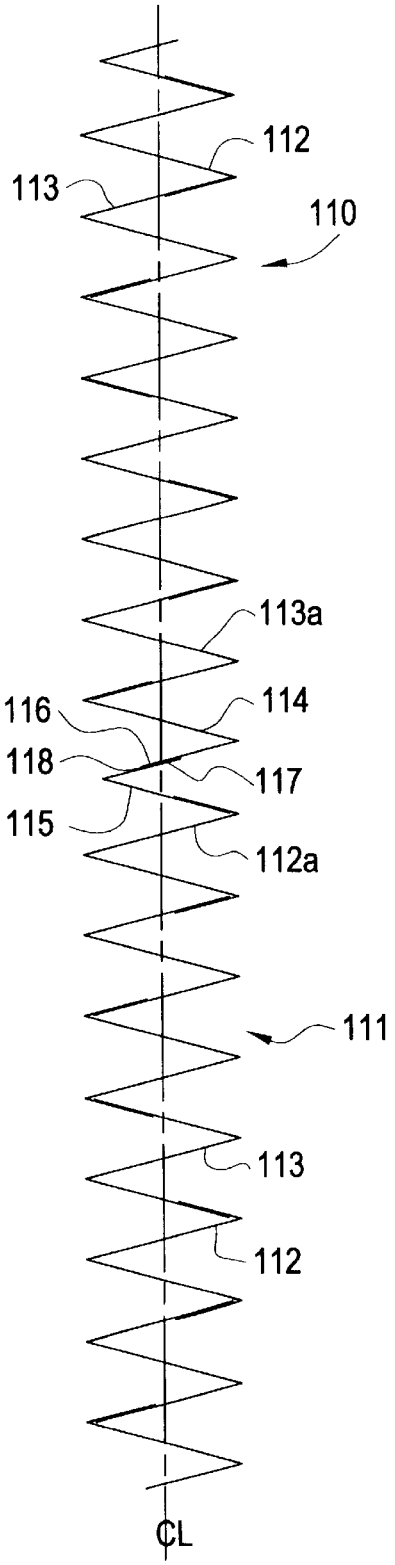
FIG. 17 illustrates a pair of clips of W-Z interfolded sheets in which adjacent clips include partial width sheets which are permanently adhesively bonded together.

FIG. 17 illustrates a pair of clips 110 and 111 of W-Z interfolded sheets which include W folded sheets 112 and Z folded sheets 113. The clip 110 includes a bottom partial width sheet 114 which is interfolded with the bottom Z folded sheet 113*a*, and the clip 111 includes a top partial width sheet 115 which is interfolded with the top W folded sheet 112*a* of the clip 111. The partial sheet 114 includes a lower end portion 116 which overlaps an upper end portion 117 of the top partial width sheet 115 to form a lap joint. The lap joint is adhesively bonded by adhesive 118. The strength of the adhesive bond is such that the partial width sheets 114 and 115 will remain adhesively bonded as they are withdrawn from the package. The unfolded width of the adhesively bonded sheets 114 and 115 is advantageously the same as the unfolded width of the W folded sheets 112 and the Z folded sheets 113.

Figure 18:
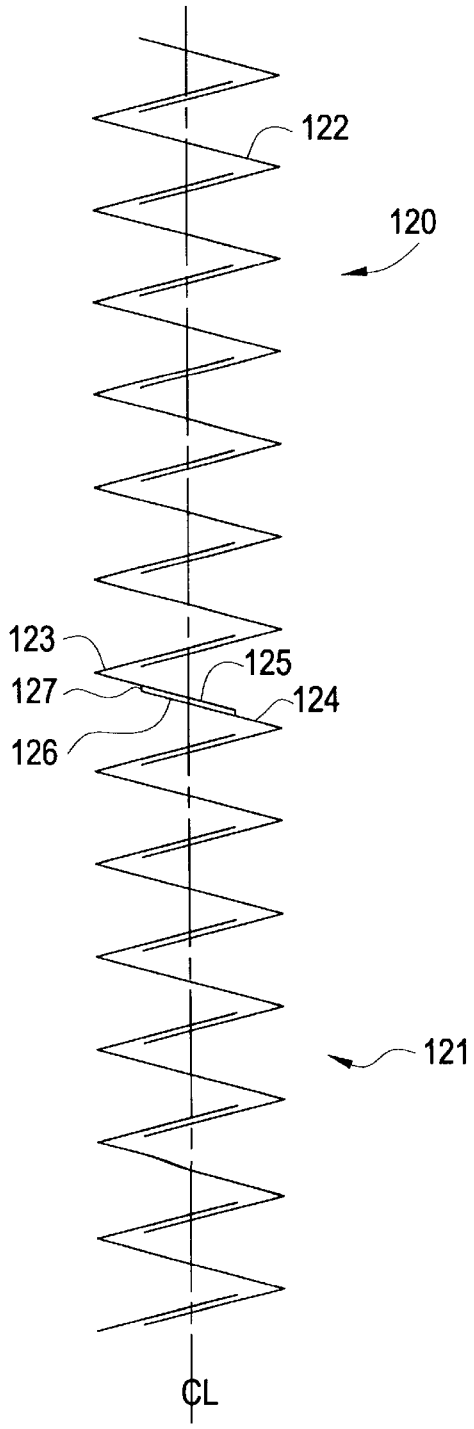
FIG. 18 illustrates a pair of clips of Z interfolded sheets in which adjacent clips include partial width sheets which are permanently adhesively bonded together.

FIG. 18 illustrates a pair of clips 120 and 121 of Z folded sheets 122. The upper clip 120 includes a bottom partial width sheet 123, and the lower clip 121 includes a top partial width sheet 124. The bottom partial width sheet 123 includes a lower end portion 125 which overlaps an upper end portion 126 of the top partial width sheet 124. The overlapped portions form a lap joint which is adhesively bonded by adhesive 127. The strength of the adhesive bond is such that the partial width sheets 123 and 124 will remain adhesively bonded when they are withdrawn from the package. The partial width sheets 123 and 124 are interfolded with the sheets above and below the partial width sheets in the same manner as the interfolding between the Z folded sheets 122 to provide consistent and continuous dispensing. The unfolded width of the adhesively bonded sheets 123 and 124 is advantageously the same or substantially the same as the unfolded width of the Z folded sheets 122.

In the preferred embodiments of the invention the bottom sheet of one clip is secured to the top sheet of the next clip by adhesive. However, other types of bonding could be used, for example, ultrasonic bonding, mechanical bonding such as crimping, and the like.

One particular type of non-adhesive bonding can be provided by including polypropylene staple fibers in the sheets which are to be bonded. The fibers are engineered to have a geometry that mechanically bonds the two sheets together, for example, by interlocking the fibers of adjacent sheets.

Figure 19:
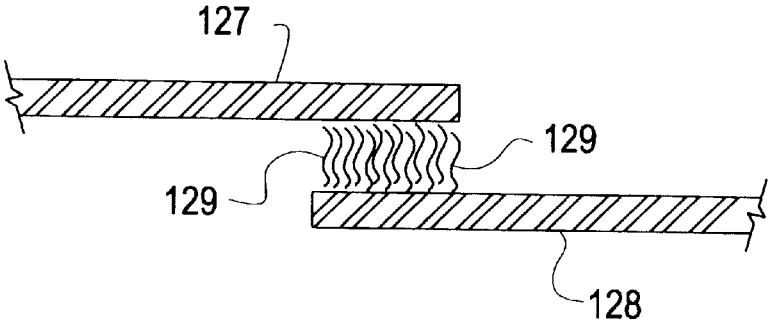
FIGS. 19–21 are enlarged fragmentary cross sectional illustrations of sheets which are bonded by interlacing fibers.
Figure 20:
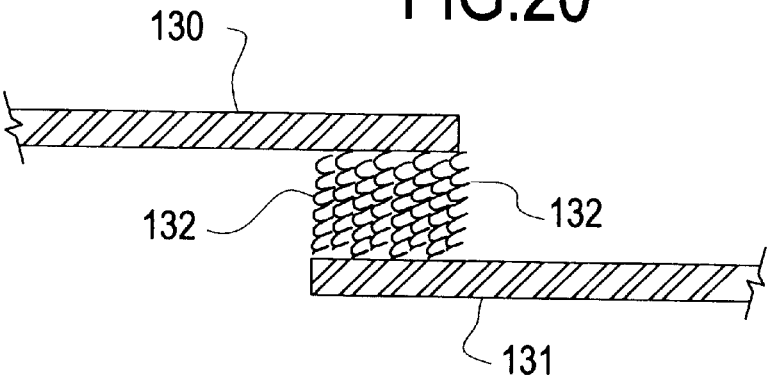
Figure 21:
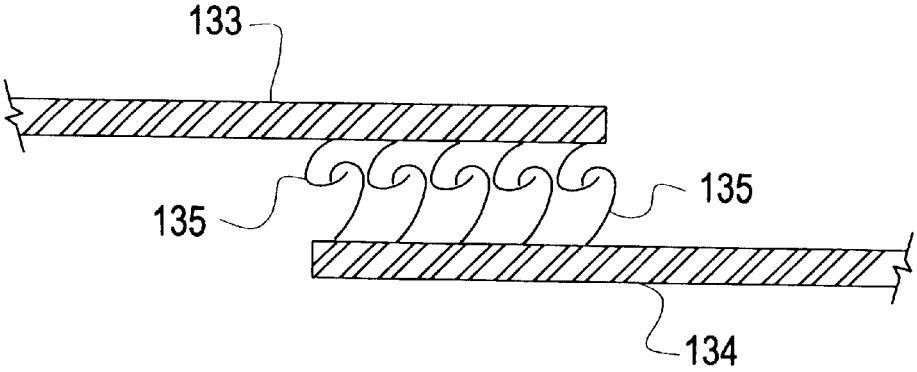

FIGS. 19–21 diagramatically illustrate various types of interlocking fibers for bonding two sheets together. In FIG. 19 upper and lower sheets 127 and 128 each include relatively straight fibers 129 which extend from the surface of the sheet. The projecting fibers are the result of the normal manufacturing process for the sheets. For example, some paper products are provided with a rough or textured surface to provide, e.g., better wickingor moisture absorption. FIGS. 19–21 show the fibers at only the ends of the sheet for clarity of illustration, but the fibers are present across the entire surface of the sheet.

The sheets 127 and 128 are pressed together to cause the fibers to interlock. The sheets are thereby attached by friction between the fibers or by a mechanical locking/bonding mechanism similar to the attachment that is provided by hook and loop fasteners sold under the trademark Velcro.

FIG. 20 illustrates sheets 130 and 131 which include curly fibers 132 which are interlocked or mechanically bonded. FIG. 21 illustrates sheets 133 and 134 which include interlocked hooked fibers.

If the bonded sheets are full width sheets, the bond is relatively weak so that the bond breaks before the lower sheet is completely withdrawn from the package. If the bonded sheets are partially width sheets, the bond is strong enough to pull the lower sheet out of the package.

While in the foregoing specification a detailed description of specific embodiments of the invention were set forth for the purpose of illustration, it will be understood that many of the details hereingiven may be varied considerably by those skilled in the art without departing from the spirit and scope of the invention.

We claim:

1. A stack of interfolded sheets comprising a plurality of groups of interfolded sheets which includes a top group and a bottom group and at least one intermediate group, each of the groups of interfolded sheets having a top panel and a bottom panel, and means for attaching the bottom panel of each group above the bottom group to the top panel of the next lower group.

2. The stack of claim 1 in which the stack includes a pair of sides, the attaching means being located between the sides in about the middle of the stack.

3. The stack of claim 1 in which the stack includes a pair of sides, the attaching means being located adjacent one of the sides.

4. The stack of claim 1 in which the attaching means comprises adhesive.

5. The stack of claim 1 in which the attaching means comprises adhesive in the shape of a swirl pattern.

6. The stack of claim 1 in which the attaching means comprises adhesive applied to both said bottom panel and said top panel.

7. The stack of claim 1 in which the attaching means comprises adhesive formed by matching adhesive patterns on both said bottom panel and said top panel.

8. The stack of claim 1 in which the stack has long side edges and short side edges and the attaching means extends continuously in a direction which is parallel to the long side edges.

9. The stack of claim 1 in which the stack has long side edges and short side edges and the attaching means extends intermittently in a direction which is parallel to the long side edges.

10. The stack of claim 1 in which the sheets are moistened.

11. The stack of claim 1 in which the sheets are dry.

12. The stack of claim 1 in which the sheets are wet and each of said bottom panel and said top panel includes a dry portion, the attaching means comprising adhesive applied to said dry portions.

13. The stack of claim 1 in which the stack has a center and each of said bottom panel and said top panel is folded to form a starter tab which is substantially aligned with the center of the stack, the attaching means comprising adhesive applied to the starter tabs.

14. The stack of claim 1 in which the attaching means comprises a mechanical bond.

15. The stack of claim 1 in which the attaching means comprises interlocking fibers in said top and bottom panels.

16. A stack of interfolded sheets comprising upper and lower groups of interfolded sheets, the upper group of interfolded sheets having a bottom panel and the lower group of interfolded sheets having a top panel, and means for attaching the bottom panel and the top panel to form a sheet which is interfolded with both the upper group and the lower group.

17. The stack of claim 16 in which said attaching means comprises adhesive.

18. The stack of claim 16 in which said attaching means comprises a mechanical bond.

19. A package of interfolded sheets comprising:

a container having a plurality of sidewalls, one of the sidewalls having an opening, a stack of a plurality of groups of interfolded sheets which includes a top group and a bottom group and at least one intermediate group, each of the groups of interfolded sheets having a top panel and a bottom panel, and means for securing the bottom panel of each group above the bottom group to the top panel of the next lower group so that the bottom panel pulls the top panel out of the opening but releases the top panel before the sheet which provides the top panel is pulled through the opening.

20. The package of claim 19 in which said securing means comprises adhesive.

21. The package of claim 19 in which said securing means comprises a mechanical bond.

22. A package of interfolded sheets comprising:

a container having a plurality of sidewalls, one of the sidewalls having an opening, a stack of interfolded sheets comprising upper and lower groups of interfolded sheets, the upper group of interfolded sheets having a bottom panel and the lower group of interfolded sheets having a top panel, and means for securing the bottom panel of the upper group to the top panel of the lower group so that the bottom panel pulls the top panel completely out of the opening when the bottom panel is withdrawn from the opening.

23. The package of claim 22 in which said securing means is adhesive.

24. The package of claim 22 in which said securing means comprises a mechanical bond.

25. The package of claim 23 in which all of said sheets have substantially the same width and each of said bottom panel and top panel have a width which is less than the width of said sheets.

26. The package of claim 25 in which the secured bottom panel and top panel provide a sheet which has a width which is substantially the same as the width of said first mentioned sheets.

27. The package of claim 26 in which said bottom and top panels include overlapping portions which form a lap joint for said securing means.

28. The package of claim 22 in which said bottom and top panels include overlapping portions which form a lap joint for said securing means.

* * * * *

US006286712C1

(12) EX PARTE REEXAMINATION CERTIFICATE (6033rd)

United States Patent

Craig et al.

(10) Number: US 6,286,712 C1

(45) Certificate Issued: Dec. 4, 2007

(54) STACK FORMED FROM CONNECTED GROUPS OF INTERFOLDED SHEETS

(75) Inventors: Grantland A. Craig, Green Bay, WI (US); James E. Hertel, Green Bay, WI (US); Gary E. Johnson, Green Bay, WI (US); Wayne W. Luebke, Green Bay, WI (US); Peter A. Heath, Plymouth (GB); Thomas D. Huempfner, Suamico, WI (US); John H. Wunderlich, Green Bay, WI (US)

(73) Assignee: Paper Converting Machine Company, Green Bay, WI (US)

Reexamination Request:
No. 90/007,747, Oct. 17, 2005

Reexamination Certificate for:

| | |
|---|---|
| Patent No.: | **6,286,712** |
| Issued: | **Sep. 11, 2001** |
| Appl. No.: | **09/488,877** |
| Filed: | **Jan. 21, 2000** |

(51) Int. Cl.

| | |
|---|---|
| ***A47K 10/24*** | (2006.01) |
| ***B65H 1/00*** | (2006.01) |

(52) U.S. Cl. ..... 221/48; 206/494

(58) Field of Classification Search ..... 221/48, 221/33, 45, 46, 49, 63; 206/494, 812, 449, 206/466; 312/34.1, 34.4, 50

See application file for complete search history.

(56) References Cited

U.S. PATENT DOCUMENTS 5,050,909 A * 9/1991 Mertens et al. ..... 283/81

FOREIGN PATENT DOCUMENTS

| | | |
|---|---|---|
| DE | 43 36 933 A1 | 5/1995 |
| EP | 0 459 645 A1 | 12/1991 |
| EP | 0 955 260 A1 | 11/1999 |

* cited by examiner

*Primary Examiner*—Matthew C. Graham

(57) ABSTRACT

A stack of interfolded sheets is formed from a plurality of groups of interfolded sheets. Adjacent groups are secured or bonded together so that the bottom sheet of each group pulls the top sheet of the next group. In one embodiment of the invention, the strength of the bond is such that when the bottom sheet of a group is withdrawn through an opening in a package for the stack, the bond releases the top sheet of the next group after the top sheet is partially withdrawn through the opening. In another embodiment of the invention, the strength of the bond is such that the top sheet remains secured to the bottom sheet and is completely withdrawn through the opening. The sheets can be secured by an adhesive bond or by a non-adhesive bond.

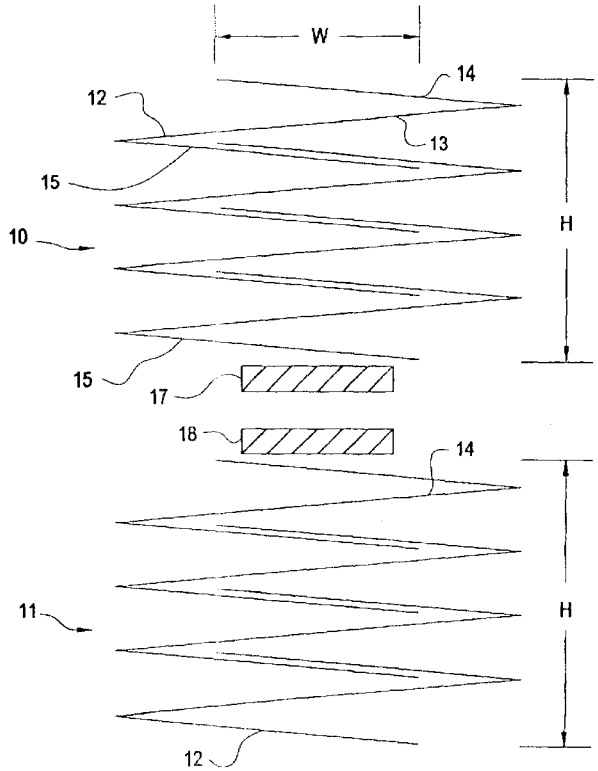

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 13, 15, 25 and 26 is confirmed. Claims 1–12, 14, 16–24 and 27–28 are cancelled.

* * * * *